US005186655A

United States Patent [19]

Glenday et al.

[11] Patent Number: 5,186,655

[45] Date of Patent: Feb. 16, 1993

[54] RF CONNECTOR

[75] Inventors: Alan J. Glenday; Frederick C. Steenhoff, both of Rochester, N.Y.

[73] Assignee: Andros Manufacturing Corporation, Rochester, N.Y.

[21] Appl. No.: 879,176

[22] Filed: May 5, 1992

[51] Int. Cl.[5] ..... H01R 13/00

[52] U.S. Cl. ..... 439/583

[58] Field of Search ..... 439/578-585

[56] References Cited

U.S. PATENT DOCUMENTS

| | | | |
|---|---|---|---|
| 3,710,005 | 1/1973 | French | 439/583 |
| 4,135,776 | 1/1979 | Ailawadhi et al. | 439/583 |
| 4,408,821 | 10/1983 | Forney, Jr. | 439/585 |
| 4,421,377 | 12/1983 | Spinner | 439/583 |

OTHER PUBLICATIONS

Forming Tools/Flare PFA Tubing in Seconds Furon Co., Fluid Handling Division, 3336 E. LaPalma Avenue Anaheim, California 92806.

*Primary Examiner*—Joseph H. McGlynn
*Attorney, Agent, or Firm*—Cumpston & Shaw

[57] ABSTRACT

A connector for an elongated cylindrical element having a deformable jacket surrounding a core includes an inner member having a sleeve, characterized by a diameter and thickness adapted to allow the sleeve to be inserted between the jacket and the core and to extend longitudinally into a space between the jacket and the core a first distance, an outer sleeve spaced radially outside the inner sleeve to form a cavity therebetween for receiving a portion of the deformable jacket, the outer sleeve extending longitudinally along the cylindrical element a distance less than the first distance; and an outer member rotatably disposed on the cylindrical element and slidably movable with respect to the inner member, and having a first cavity for receiving the inner member and a radially inwardly extending flange for engaging the deformable jacket and deforming at least a portion of the jacket radially outwardly to anchor the connector with respect to the elongated cylindrical element.

9 Claims, 6 Drawing Sheets

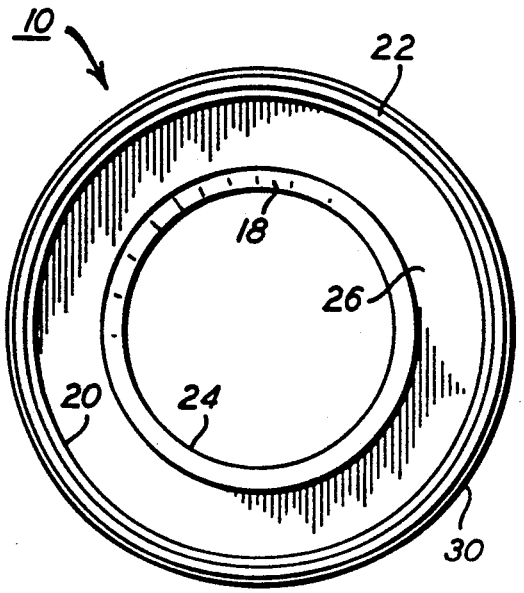
FIG. 1
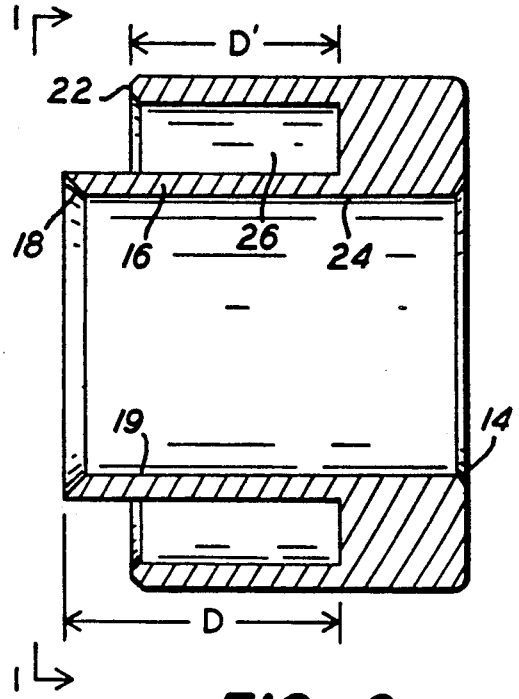
FIG. 2
FIG. 3
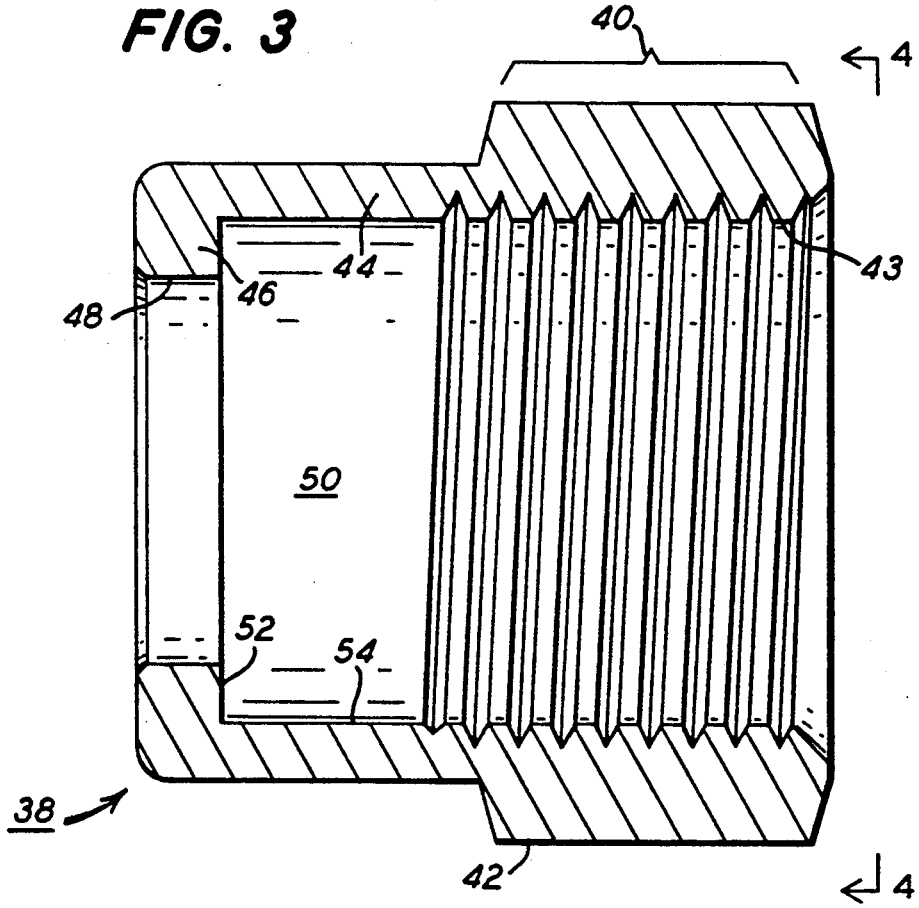

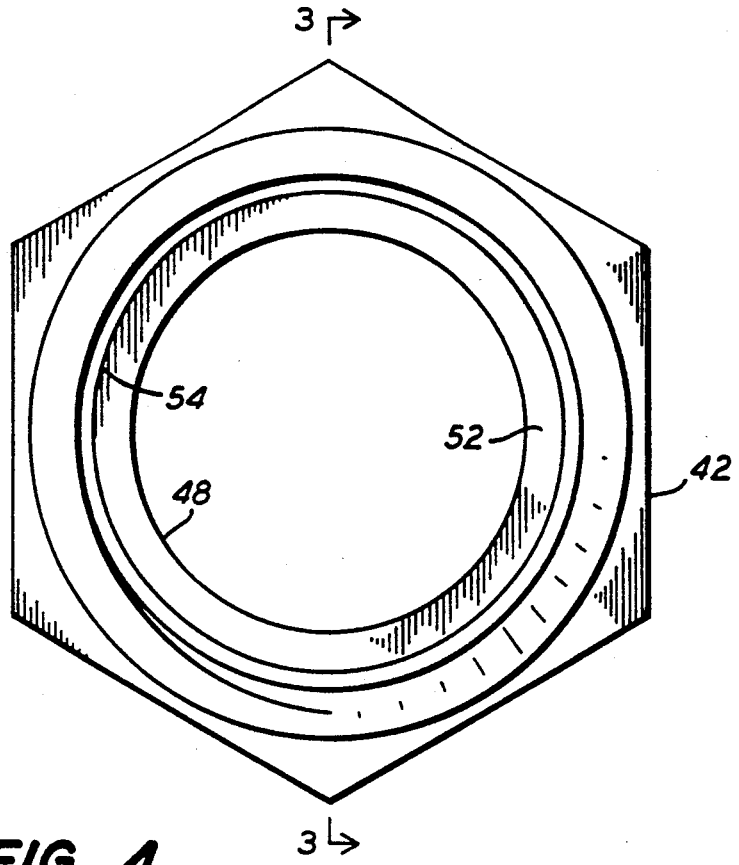
FIG. 4
FIG. 9
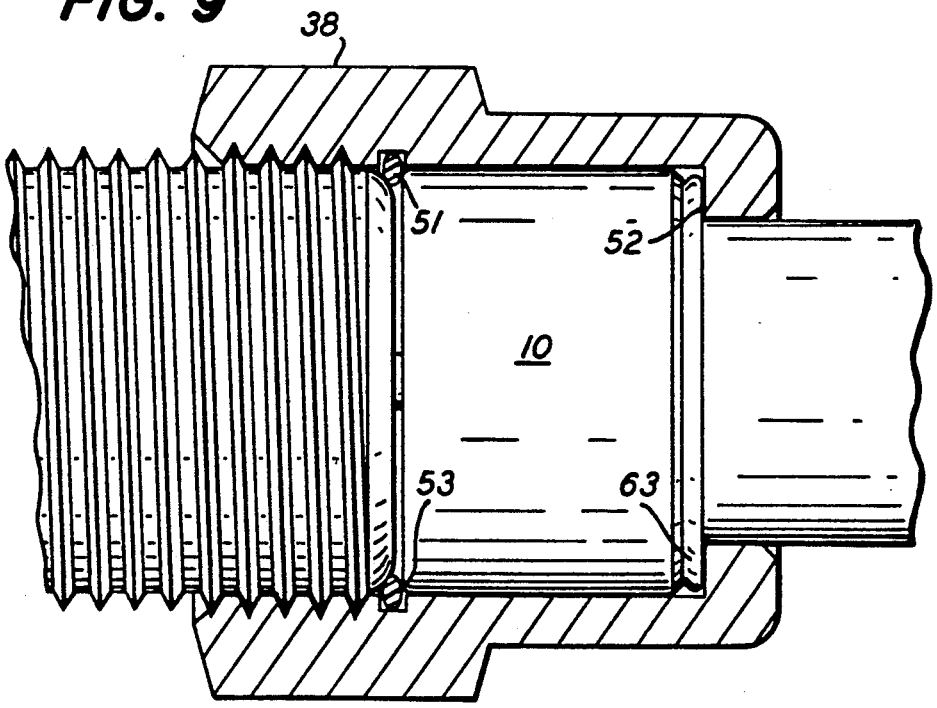

RF CONNECTOR

This invention relates generally to connectors and more particularly to a connector for a jacketed co-axial cable, but which can also be used on other elongated cylindrical elements having deformable jackets surrounding a core.

There is a need for an easy to install connector for plastic jacketed coaxial cable and the like, especially the relatively small diameter plastic jacketed cable of the RG59 and RG6 types commonly used in the CATV industry.

It is especially desirable to provide such a connector that can be installed without special tools. It is also desirable to provide such a connector that can withstand a significant tension on the cable in the longitudinal direction, tending to pull the connector off the end of the cable.

One type of connector that the present invention addresses particularly is called an F connector, and is used on coaxial cable having a solid, inner conductor surrounded by a dielectric core, which is in turn surrounded by a braided shield and a plastic jacket. Existing connectors of the type over which the present invention is an improvement commonly include a shell with a longitudinally extending sleeve that slips between the dielectric core and the braid, together with a deformable ferrule that can be slid over the plastic sleeve to a position overlapping the core, where it can be deformed to secure the connector with respect to the cable.

This known F type connector, though extremely widely used, has several disadvantages with respect to the connector of the present invention. First, it requires a crimping tool to install, and second, it can withstand a longitudinal force of only about 25–28 lbs. applied in the direction tending to pull the cable out of the connector.

Another disadvantage is that in order to weatherproof the known F type connector for outside use, it is necessary to apply a rubber boot or the like over the assembly, after the connector is installed.

It is an object of this invention to provide a new connector that can be installed without special tools, that is simple in construction, and therefore inexpensive to produce, that can withstand longitudinal forces tending to separate the connector from the cable that are at least as high and preferably significantly higher than those characterizing known connectors, and that is at least somewhat weather resistant without the use of a rubber sleeve.

While the connector of this invention was designed and has particular utility for use with plastic jacketed coaxial radio frequency cable, it has other applications. For example, the connector of this invention may be used to make connections to other plastic jacketed cylindrical members, such as air or vacuum hoses and the like.

Briefly stated, and in accordance with the presently preferred embodiment of this invention, a connector for an elongated cylindrical element having a deformable jacket surrounding a core includes an inner member having a sleeve, characterized by a diameter and thickness adapted to allow the sleeve to be inserted between the jacket and the core and to extend longitudinally into a space between the jacket and the core a first distance, an outer sleeve spaced radially outside the inner sleeve to form a cavity therebetween for receiving a portion of the deformable jacket, the outer sleeve extending longitudinally along the cylindrical element a distance less than the first distance; and an outer member rotatably disposed on the cylindrical element and slidably movable with respect to the inner member, and having a first cavity for receiving the inner member and radially inwardly extending means for engaging the deformable jacket and deforming at least a portion of the jacket radially outwardly to anchor the connector with respect to the elongated cylindrical element.

The novel aspects of the invention are set forth with particularity in the appended claims. The invention itself, together with additional objects and advantages thereof, may be more readily comprehended by reference to the following detailed description of the invention, taken in conjunction with the accompanying drawings, in which:

FIG. 1 is an end elevation of the inner member of a connector in accordance with this invention;

FIG. 2 is a sectional view of the member of FIG. 1 taken along lines 2—2;

FIG. 3 is a section of the outer member taken along lines 4—4 of FIG. 4; and FIG. 4 is an end elevation of an outer member in accordance with this invention;

FIG. 9 is a section of and embodiment of the connector of this invention with a seal shown installed on a coaxial cable and connected to a female connector;

Figure 5:
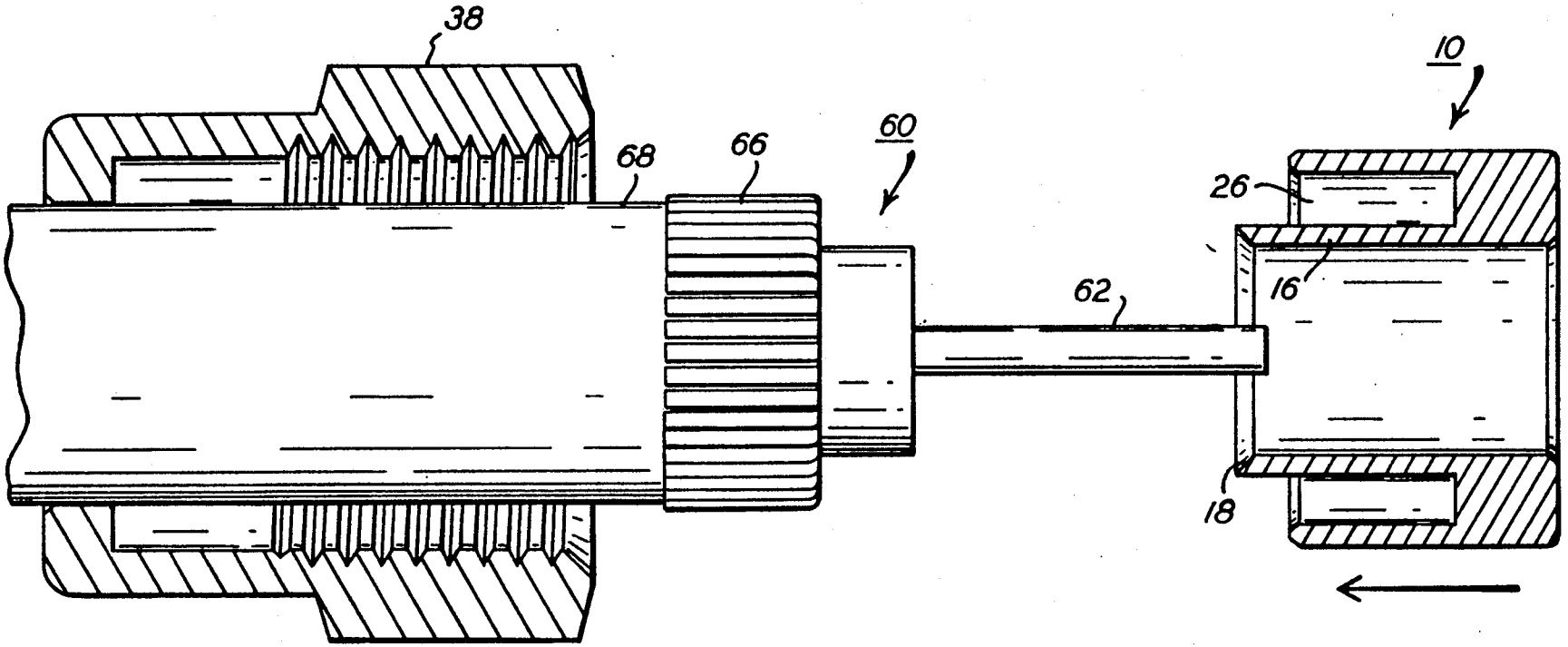
FIG. 5 is an exploded view showing how the connector of this invention is installed on a coaxial cable.

Referring now to FIGS. 1 and 2, the inner member 10 of a connector in accordance with this invention includes an annular body 12 having a generally rectangular cross section and an inner sleeve 16 and a coaxial outer sleeve 20. Preferably, the edge 14 is chamfered, bevelled or rounded.

The inner sleeve 16 extends longitudinally from the body 12 a distance D to a preferably bevelled distal end 18. Preferably, the inner surface 19 of the inner sleeve 16 has the same diameter as the inside diameter of the annular body 12, and forms a continuous smooth surface therewith.

The member 10 also includes the cylindrical outer sleeve 20 preferably extending from an outer surface of the annular body 12, coaxial with the inner sleeve 16 a distance D' that is less than the distance D. The outer sleeve 20 is preferably rounded or tapered at its distal end 22. The outside sleeve 20 has an outside diameter equal to the outside diameter of body 12 and forms a continuous outer surface therewith.

Generally, the inner member 10 is characterized by a smooth walled through bore 24, the inner sleeve 16, an annular cavity 26 defined by the inner sleeve 16, the body 12, and the outer sleeve 20, and a smooth walled outer surface 30.

FIGS. 3 and 4 show an outer member 38 of a connector in accordance with this invention. The outer member 38 includes an annular body portion having a threaded inner surface 40, a faceted preferably hexagonal outer surface 42, and a threaded bore 43. A longitudinally extending annular sleeve 44 extends from the threaded portion of the body of the outer member 38 to an inwardly extending annular flange 46 that terminates in an annular engaging surface 48 and forms an open cavity 50. The cavity 50 is defined at one end by deforming surface 52 on the inside of flange 46 that is perpendicular to a cylindrical inner wall 54 of the sleeve 44. Cavity 50 is sized to slidably receive inner member 10 therein, as will be described more completely below.

Figure 6:
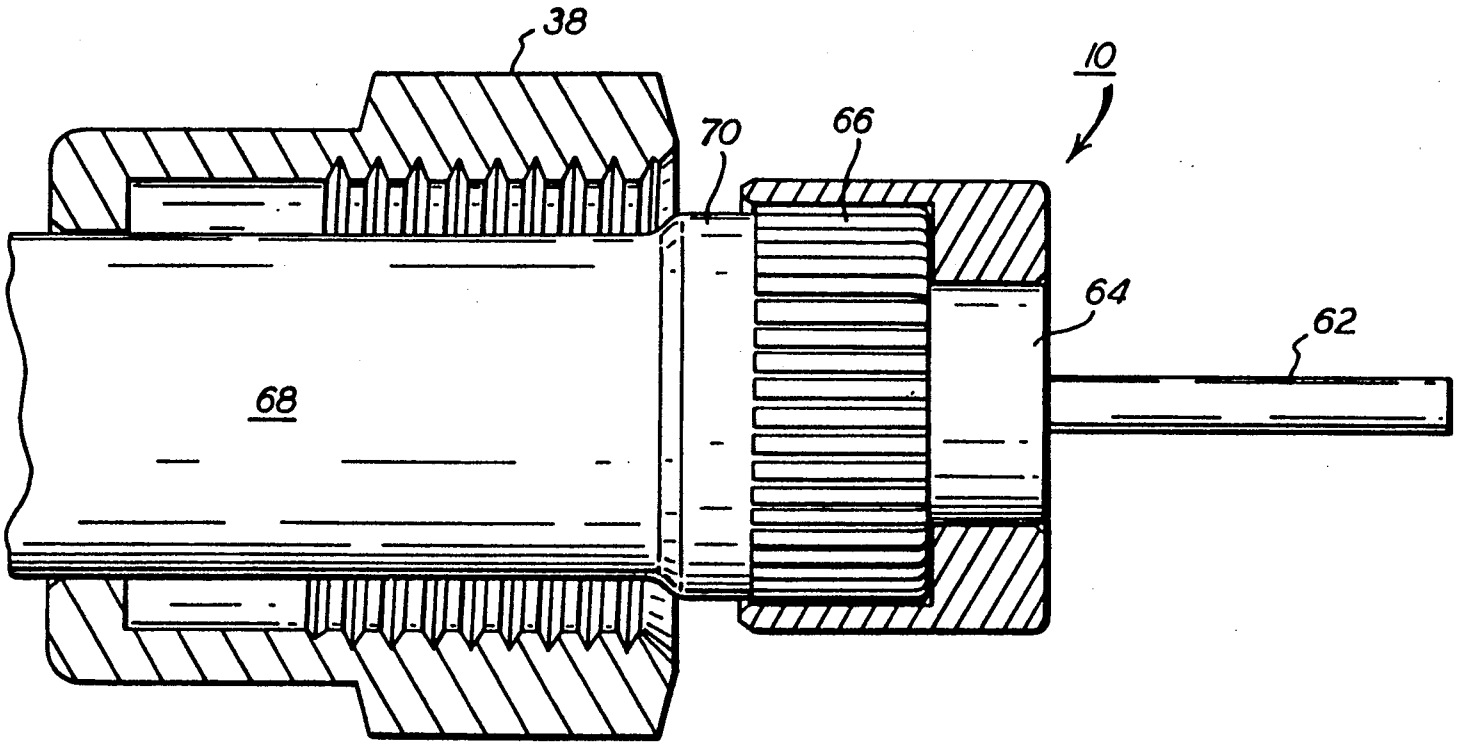
FIG. 6 is a side elevation, partly in section, showing the connector of this invention partly installed on the coaxial cable.

The manner in which the connector in accordance with this invention is installed on a coaxial cable is illustrated in FIGS. 5 and 6. A plastic jacketed cable designated generally at 60 includes an inner conductor 62 that is usually made of copper or aluminum, a dielectric core 64 surrounding the inner conductor 62, a foil or braided conductive shield 66 surrounding the dielectric core, and a plastic jacket 68 surrounding the shield.

The cable is prepared for installation of the connector of this invention by sliding the outer element 38 over the plastic jacket 68, and trimming the inner conductor 62, dielectric core 64, shield 66 and plastic jacket 68, and folding the shield 66 back over a portion of the jacket 68 as shown in FIG. 5. The inner conductor extends a desired distance beyond the end of the dielectric core, the dielectric core extends at least slightly beyond the end of the plastic jacket, and the shield is folded back over the end of the jacket a distance approximately equal to the depth of the cavity 26.

The inner member 10 of the connector is then slid on to the prepared end of the cable. The bevelled distal end 18 of the inner sleeve 16 is inserted between the dielectric core 64 and the shield 66, and the shield covered end of the plastic jacket 68 is inserted into cavity 26 as far as it will go. The resulting assembly is shown in FIG. 6. As can be seen in FIG. 6, the plastic jacket 68 is slightly deformed radially outwardly by the inner sleeve 16, and forms a slight bulge 70 where the jacket extends over the distal end 18 of the inner sleeve.

Figure 7:
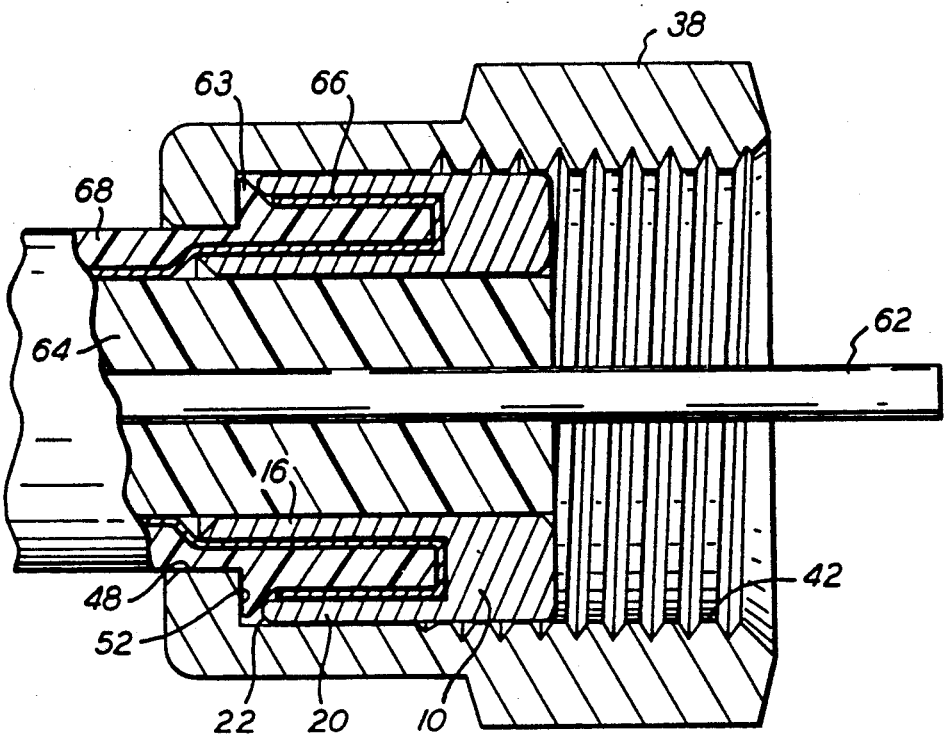
FIG. 7 is a fragmentary sectional view of the connector of this invention completely intalled on a coaxial cable.
Figure 8:
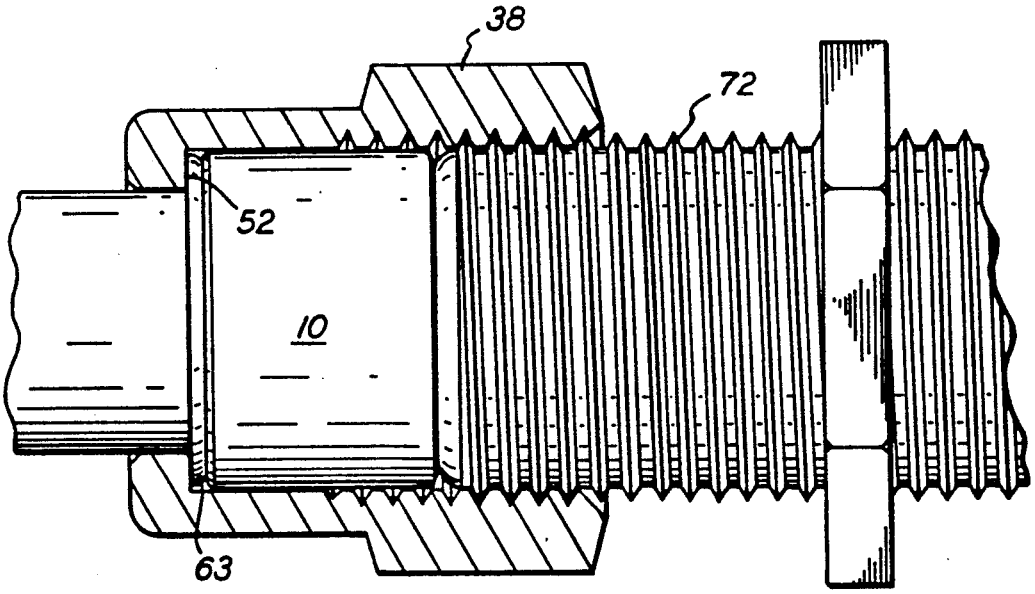
FIG. 8 is a section of the connector of this invention shown installed on a coaxial cable and connected to a female connector.

Referring now to FIGS. 7 and 8, the completed assembly is shown partly in section and connected to a female connector 72 (FIG. 8 only). The outer member 38 has been slid into position over the inner member 10 with the inner member 10 substantially disposed within the cavity 30 of the outer member 38. The plastic jacket has been engaged by the deforming surface 52 of the outer member 38 and a portion 63 of the jacket is deformed radially outwardly, by the deforming surface 52 to a position between the distal end 22 of outer sleeve 20 of inner member 10. Preferably, the radial space between engaging surface 48 and the outside of sleeve 16 is at least slightly less than the thickness of jacket 68. The outer member 38 is freely rotatable with respect to the inner member 10 to allow the threaded portion 42 to be screwed on to a female connector 72 as shown in FIG. 8. The inner conductor 62 extends slightly beyond the end of the threaded portion. The conductive shield 66 firmly engages the inside surface of the cavity 26, and forms an ohmic electrical connection therewith.

Preferably, the outside diameter of the inner member 10 and the inside diameter of the outer member 38 are selected so that sliding contact between the two members is created along with an ohmic electrical connection.

If it is desired to provide a wholly or substantially waterproof connector, an optional sealing ring 51 is preferably disposed in an annular recess 53 within the threaded portion of the outer portion 38, as shown in FIG. 8.

Preferably, the inner and outer members are formed from easily machinable electrically conductive materials such as brass or the like, but other suitable materials may be employed as necessary.

Figure 10:
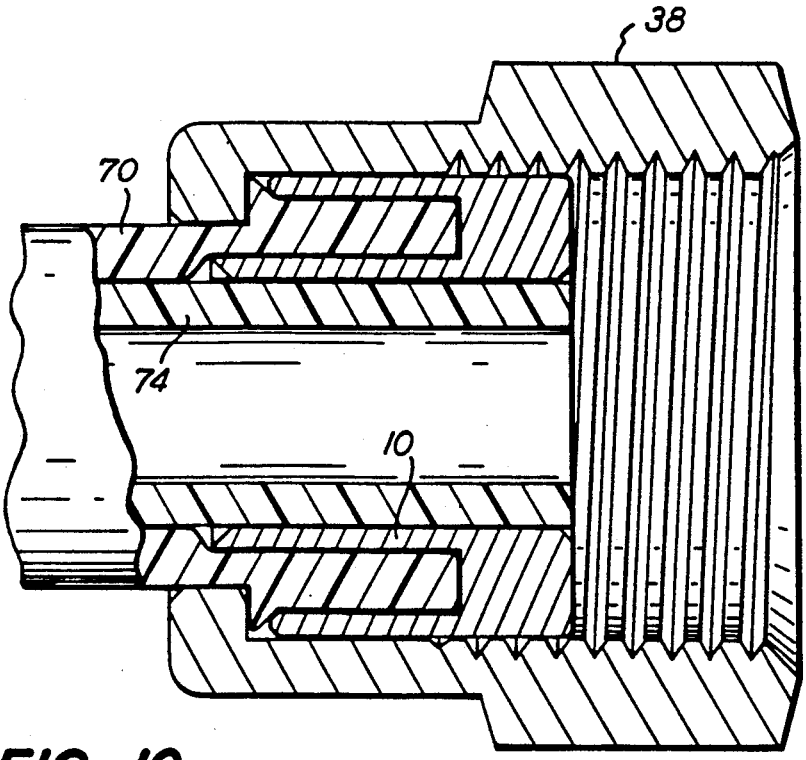
FIG. 10 is a fragmentary sectional view of the connector of this invention installed on a hose with a core.
Figure 11:
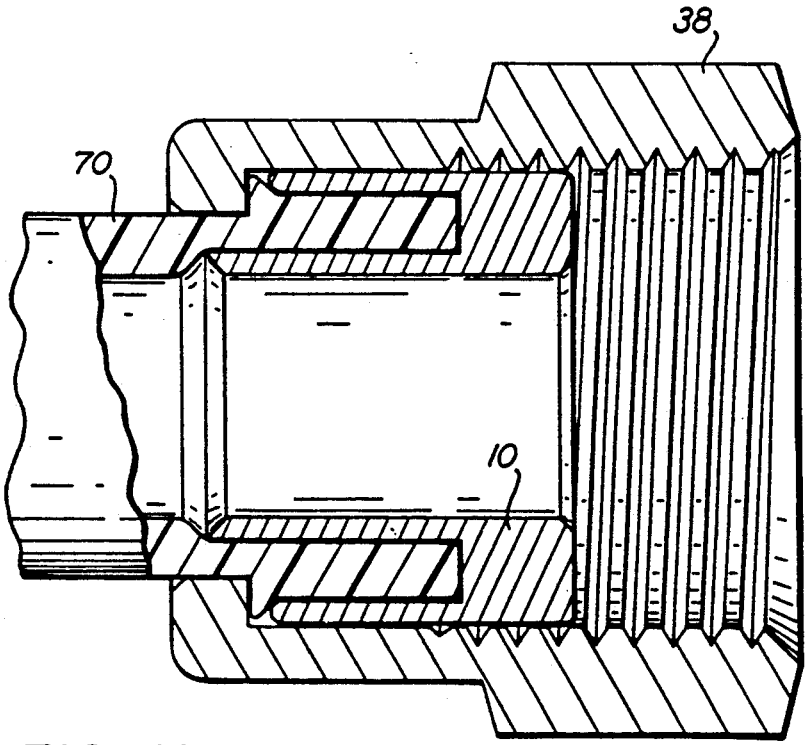
FIG. 11 is a fragmentary sectional view of the connector of this invention shown installed on a hose without a core.

While the invention has been shown in connection with an electrical connector, it may also be employed for pneumatic hoses, including hoses that have a plastic jacket surrounding a cylindrical core, so that the inner sleeve of the inner member may be inserted between the jacket and the core. Such a construction is shown in FIG. 10. The construction is identical to FIG. 7 except that the jacket 70 surrounds a hollow core 74 in place of dielectric 64. The connector may also be used on a tube or hose without a core, as shown in FIG. 11. The connector functions in substantially the same way as in FIG. 10, except that the core is not present.

The connector of this invention, as exhibits substantially improved resistance to longitudinally applied forces tending to pull the connector off the end of the cable. Typically, the connector will withstand forces of about 35 lbs. or more, when applied to plastic jacketed cable of the RG59 or RG6 type normally used in the cable television industry.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. A connector for an elongated cylindrical element having a deformable jacket surrounding a core, comprising:

an inner member including a sleeve characterized by a diameter and thickness adapted to allow the sleeve to be inserted between the jacket and the core and to extend longitudinally into a space between the jacket and the core a first distance, an outer sleeve spaced radially outside the inner sleeve to form a cavity therebetween for receiving a portion of the deformable jacket, the outer sleeve extending longitudinally along the cylindrical element a distance less than the first distance; and an outer member rotatably disposed on the cylindrical member and slidably movable with respect to the inner member, having a first cavity for receiving the inner member and radially inwardly extending means for engaging the deformable jacket and deforming at least a portion of the jacket radially outwardly to anchor the connector with respect to the elongated cylindrical element.

2. The connector of claim 1 in which the outer member comprises a faceted body portion having a threaded interior surface;

a sleeve extending outwardly from the body portion and a flange disposed at one end of the sleeve and extending inwardly to an annular engaging surface, the sleeve defining at an interior edge thereof a deforming surface for engaging the deformable jacket.

3. The connector of claim 1 in which the outside diameter of the inner member and the inner diameter of the outer member are selected so that the members are rotatable with respect to each other, but form an ohmic electrical contact therebetween when installed on the elongated cylindrical element.

4. The connector of claim 1 in which the inner sleeve comprises means for locally deforming the deformable tube to form a bulge.

5. The connector of claim 1 in which the inner sleeve comprises means for locally deforming the deformable jacket to form a bulge.

6. The connector of claim 5 in which the radially inwardly extending means on the outer member engages the jacket where it is deformed by the sleeve of the inner member, and further deforms and captures the jacket between the inner and outer members to secure the connector to the elongated cylindrical element.

7. The connector of claim 5 in which the radially inwardly extending means on the outer member engages the tube where it is deformed by the sleeve of the inner member, and further deforms and captures an annular rim of the tube between the inner and outer members to secure the connector to the elongated cylindrical element.

8. A connector for an elongated cylindrical element having a plastic deformable jacket surrounding a core comprising:

first and second members slidably mounted with respect to each other on the elongated cylindrical element, the first and second members cooperating when installed on the element to form a radially outwardly extending cavity, said first and second members including first and second jacket engaging elements respectively, for engaging and deforming a portion of said jacket radially outwardly within said cavity for securing the connector to the cylindrical element.

9. A connector for an elongated plastically deformable tube comprising:

an inner member including a sleeve characterized by a diameter adapted to allow the sleeve to be inserted between the jacket and the core and to extend longitudinally therein a first distance, an outer sleeve spaced radially outside the inner sleeve to form a cavity therebetween for receiving a portion of the deformable tube, the outer sleeve extending longitudinally along the cylindrical element a distance less than the first distance; and an outer member rotatably disposed on the cylindrical member and slidably movable with respect to the inner member, having a first cavity for receiving the inner member and radially inwardly extending means for engaging the deformable tube and deforming at least a portion of the jacket radially outwardly to anchor the connector with respect to the elongated cylindrical tube.

* * * * *